United States Patent [19]

Puresevic et al.

[11] Patent Number: 4,673,095

[45] Date of Patent: Jun. 16, 1987

[54] CLOSURE DEVICE FOR CONTAINERS

[76] Inventors: Peter J. Puresevic, 42, The Ridings, Tonteg, Pontypridd; Julian D. Taylor, 1, Fairway, Drive, Pwllypant, Caerphilly, both of Mid Glamorgan; Denis O'Sullivan, 4, Alwyn Drive, Barry, South Glamorgan, all of Wales

[21] Appl. No.: 796,338

[22] Filed: Nov. 12, 1985

[30] Foreign Application Priority Data

Nov. 12, 1984 [GB] United Kingdom ..... 8428547
Jan. 24, 1985 [GB] United Kingdom ..... 8501843
Jan. 29, 1985 [GB] United Kingdom ..... 8502181

[51] Int. Cl.[4] ..... B65D 55/02; B65D 85/56
[52] U.S. Cl. ..... 215/220
[58] Field of Search ..... 215/219, 220

[56] References Cited

U.S. PATENT DOCUMENTS 4,011,960 3/1977 Maurernay et al. ..... 215/220
4,394,916 7/1983 Smalley ..... 215/220
4,555,036 11/1985 Bekkers et al. ..... 215/220

*Primary Examiner*—George T. Hall
*Attorney, Agent, or Firm*—Lowe Price Leblanc Becker & Shur

[57] ABSTRACT

A closure device for screw-threaded cylindrical container openings comprises inner and outer closure members having a first drive arrangement therebetween for turning the device clockwise to mount same to close the opening. A second drive arrangement comprises a hexagonal projection and a hexagonal orifice on the members which engage on application of axial pressure to the device to permit, on applying an anti-clockwise torque, unscrewing of the device from the opening. The orifice may be initially closed by a cover secured to the boundary by the orifice by frangible connectors which are fractured by the projection on initial axial pressure being applied. This provides a tamper evident feature. In other embodiments, a cover has a manually graspable tab for tearing it from the opening before axial pressure is applied.

16 Claims, 17 Drawing Figures

CLOSURE DEVICE FOR CONTAINERS

The invention relates to a closure device for containers, particularly a container such as a pill or other medicine bottle having a cylindrical opening.

Generally, closure devices such as screw-threaded caps of containers with a screw-threaded opening such as a neck can be removed relatively easily by unscrewing. This can be dangerous when the container houses drugs, dangerous chemicals and the like and a child for example unscrews the closure device and gains access to the contents and then takes the contents with possibly harmful or even fatal results. Closure devices which seek to provide for safer or authorised opening of the container have been proposed, but they are generally complex and expensive.

According to the invention there is provided a closure device for a container with a cylindrical opening, comprising a first and a second cylindrical closure member each with an end member and a depending skirt member, first drive means between the first and second closure members for driving the members in unison in one sense only to mount the closure on the opening, and a second drive means operative on axial pressure on the closure to drive the closure in the opposite sense for removal from the opening, the second drive means comprising an orifice through one end member and a projection on the other end member, whereby on engagement of the projection in the orifice, the closure members are turnable in unison in the opposite sense to the one sense for removing the device from the opening.

The orifice may be through the first or outer end member and the projection may be on the second or inner end member.

The orifice and projection may be of complementary shape.

The orifice and projection may have a hexagonal shape as considered in plan view.

There may be a plurality of orifices and projections.

There may suitably be more orifices than projections.

There may preferably be eight orifices and two projections.

The orifices may be radially arranged and equiangularly spaced around the first or outer end member and the projections may be diametrically arranged on the second or inner end member.

The orifices and projections may be substantially rectangular in configuration as considered in plan view.

The orifice may be substantially hexagonal and the projection rectangular in plan view.

The orifice and projection may be substantially rectangular in plan view.

The orifice and projection may in a further embodiment be substantially cruciform in plan view.

Again, the orifice and projection may be substantially arcuate in plan view.

The or each orifice may be closed at least in part by a cover.

The or each cover may be secured to the end member by means which is frangible by the projection on said axial movement.

The or each cover may have a tab and may be secured to the end member by means which is frangible on pulling the tab.

The first drive means may comprise ratchet and teeth means between the first and second closure members.

According to a second aspect of the invention there is provided a container with a cylindrical opening including a closure device as hereinbefore defined mounted on the cylindrical opening.

The inner and outer closure members may be formed from plastics material by injection moulding.

Closure devices embodying the invention and hereinafter described, by way of example, with reference to the accompanying drawings.

Figure 9:
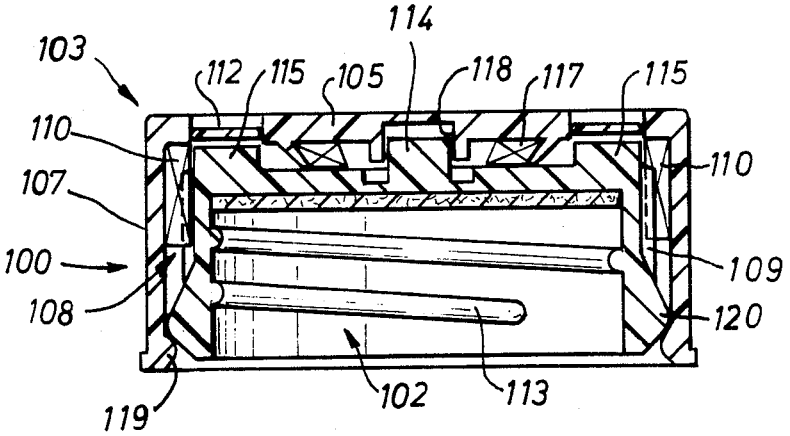

FIG. 9 is, to a scale larger than that of FIGS. 5 to 8, a sectional transverse view of the second closure device according to the invention assembled from the inner and outer caps respectively shown in FIGS. 5 and 6 and 7 and 8.

Figure 10:
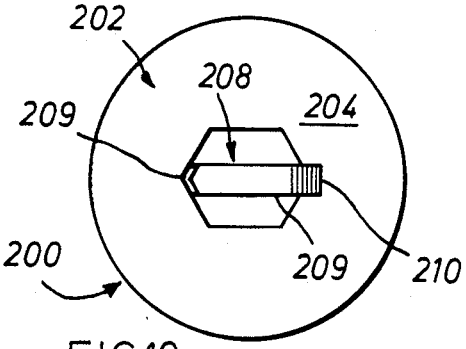
Figure 11:
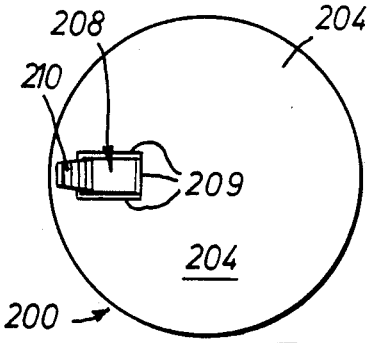
Figure 10A:
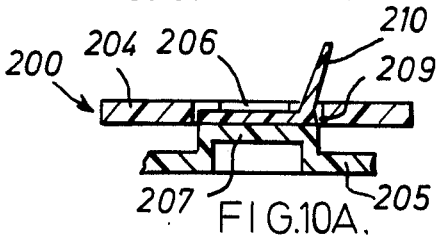
Figure 11A:
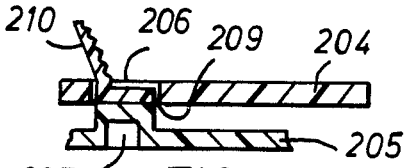
Figure 12:
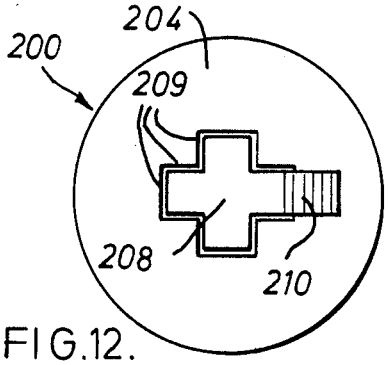
Figure 13:
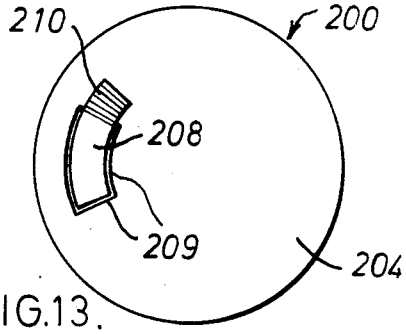
Figure 12A:
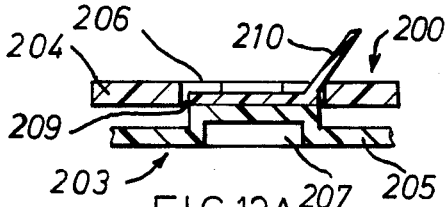
Figure 13A:
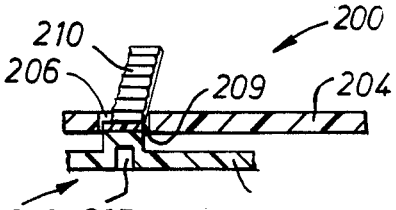

FIGS. 10 and 10A show respectively a plan and part sectional views of a third closure device according to the invention; and FIGS. 11 and 11A, 12 and 12A, and 13 and 13A show respectively views similar FIGS. 10 and 10A of fourth, fifth and sixth embodiments of closure device according to the invention.

Referring firstly to FIGS. 1 to 4 of the drawings, the closure device 1 shown is injection moulded from plastics and is for mounting on an externally threaded cylindrical opening of a container (not shown) such as a pill or medicine bottle.

The closure device 1 has a first or outer cylindrical closure member 2 and a second or inner cylindrical closure member 3, each with a respective end member 4 and 5 and a depending skirt member 6 and 7. There is first drive means between the first and second closure members 2 and 3 in the form of a series of peripheral upstanding teeth 8 on the end member 5 of the inner closure member 3 and a series of projecting lugs or bosses 9 on the end member 4 of the outer closure member 2 which engage the teeth 8 for turning the closure members 2 and 3 in unison in the clockwise sense only, to mount the closure device on the opening, screw threads 10 of the skirt member 7 of the inner closure member 3 engaging screw threads of the opening. The teeth 8 have inclined rear surfaces 11 so that if the outer closure member 2 is rotated in the opposite, anti-clockwise sense, the lugs or bosses 9 rise over the teeth 8 so that the inner and outer closure members 2 and 3 do not turn in unison in the anti-clockwise direction to open the container.

The closure members 2 and 3 also include second drive means in the form of a centrally located orifice 12 through the end member 4 of the outer closure member 2 and an axially aligned projection 13 on the end member 5 of the inner closure member 3. The orifice 12 and projection 13 have respective cooperative driving means in the form of cooperable, angled flat driving surfaces 14 and 14', in this case arranged to form a hexagon.

Figure 1:
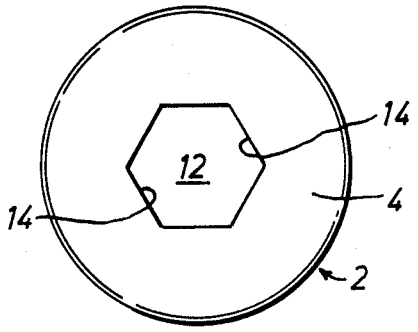
FIG. 1 is a plan view of a first or outer closure member of a first closure device according to the invention.
Figure 2:
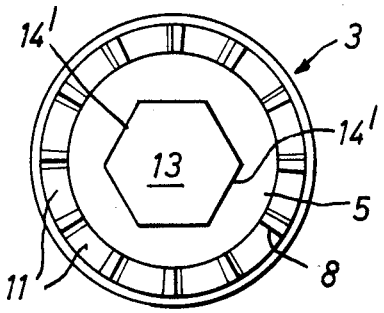
FIG. 2 is a plan view of a second or inner closure member of the first closure device according to the invention.
Figure 3:
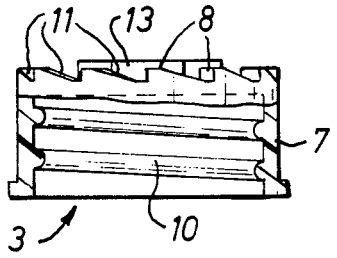
FIG. 3 shows a longitudinal sectional view of the member of FIG. 2.
Figure 4:
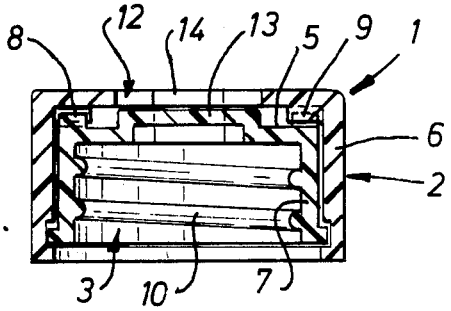
FIG. 4 shows a longitudinal sectional view of the first closure device when the inner and outer closure members are assembled together.
Figure 5:
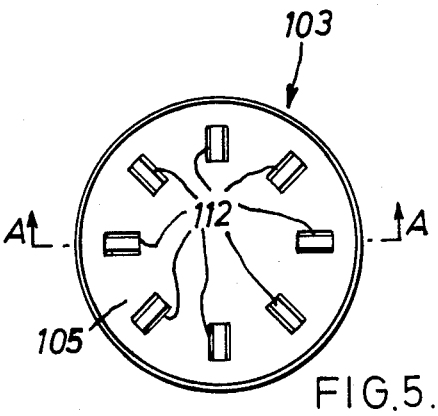
FIG. 5 is a plan view of an outer closure member of a second closure device according to the invention.
Figure 7:
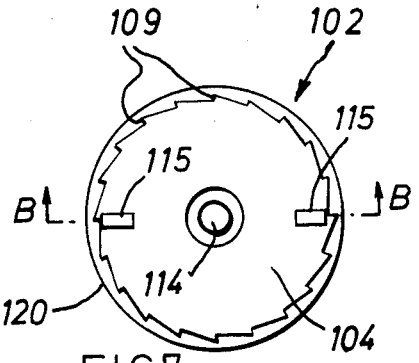
FIG. 7 is a sectional view of an inner closure member of the second closure device according to the invention, for use inside the closure member of FIG. 5.
Figure 6:
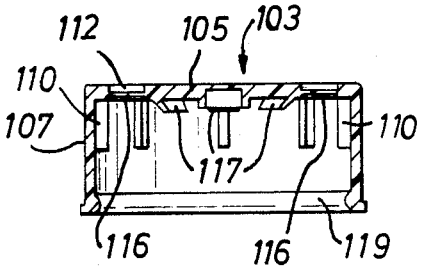
FIG. 6 is a section view of the closure member of FIG. 5, taken on the line A—A of that FIG.
Figure 8:
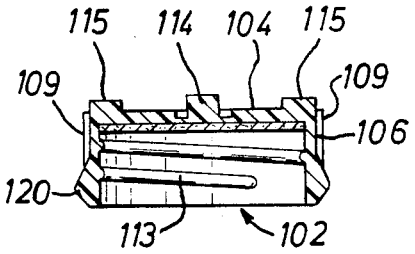
FIG. 8 is a sectional view of the closure member of FIG. 6, taken on the line B—B of that FIG.

Normally the projection 13 is below the orifice 12 as shown in FIG. 4. It it is desired for an authorised person to remove the safety closure 1 from a container opening to which it has been applied, it is merely necessary to apply axial pressure to the outer closure member 2 so that the orifice 12 rides round the projection 13, which is a close sliding fit in the orifice 12. If torque is now applied the faces 14 and 14' ensure that the projection and orifice engage in a non-slip fashion to drive the inner and outer members 2 and 3 in unison in the anticlockwise or unscrewing sense. It will be understood that the axial pressure applied is applied to overcome the natural resilience of the engaged first drive means 8 and 9 sufficiently for the orifice 12 and projection 13 to be engaged for turning in the opposite sense. On release of the axial pressure, this natural resilience returns the closure members to the FIG. 4 or inoperative position.

It will be understood that there may be additional specific means between the two end members specifically to urge the closure members 2 and 3 apart to the FIG. 4 position, though not far enough apart to disengage the teeth 8 and lugs 9.

It will also be understood that the orifice 12 may be initially closed by a film or disc of plastics formed during moulding and which is broken or removed by the projection 13 on first application of axial pressure, to indicate that a first opening of the container has been attempted. This can be made more readily apparent if the inner and outer closure members are made of plastics of different colours, for example white for the outer closure member and red for the inner closure member. Also, the projection and orifice can have any desired configuration providing they interlock for a driving action, for example they can be square, triangular or of any other configuration such as starshape.

Referring now to FIGS. 5 to 9 of the drawings, a closure device 100 for a container having a cylindrical opening such as a pill bottle with a screw-threaded neck, has an inner closure member 102, and an outer closure member 103, which members each comprise an end member 104 and 105 respectively and a respective skirt member 106 and 107. The end members are spaced apart. First drive means 108 in the form of ratchets 109 and teeth 110 between the respective skirt members 106 and 107 drive the closure members in unison on rotation in a sense to mount the device 100 on the opening. There is second drive means 110 operative to drive the closure members 102 and 103 on rotation in the opposite sense in unison when the outer closure member 103 is moved axially in the direction of arrow "A" in a direction to bring the end members 104 and 105 closer together. The second drive means 110 includes a frangible means 112 of the outer closure member 103 which is broken on such axial movement to engage the second drive means 110 for rotational movement of the inner and outer closure members in unison in said opposite sense.

The inner cylindrical closure member of cap 102 is smaller on its outer diameter than the inner diameter of the outer cylindrical closure member or cap 103, so there is a gap between the skirts 106 and 107 of the two caps in which the first drive means 108 is situated. The first drive means for turning the two caps 102 and 103 in unison on rotation in one sense to tighten the closure device on the opening of a bottle (not shown) (which has a thread for mating with a thread 113 of the skirt of the inner cap) comprises a series of equally circumferentially spaced apart said ratchets 109 on the outer (as viewed) surface of the skirt 106 and four said driving dogs 110 equidistantly circumferentially spaced apart on the inner (as viewed) surface of the skirt 107. The dogs 110 are resilient and the ratchets taper longitudinally upwardly as considered in use.

The outer surface of the end member 104 of inner cap 102 has a central upstanding boss 114 and two lugs 115 diametrically spaced apart on opposite sides of the boss 14. The lugs 115 are elongate and radially directed.

The end member 105 of the outer cap 103 has a circular depending wall 118 aligned with the boss 114 in the assembled closure device 100 and of slightly greater diameter than the boss 114 and of such a height that the skirt and boss just overlap in the position in which the closure device is in position on the opening (or neck) of a bottle.

The end member of the outer cap also has a circular array of openings 116 similar shape to the lugs and of substantially the same size as the lugs 115. Moreover, the openings 116 are radially arranged in diametrically opposed pairs. Each opening is closed by the frangible means 112 in the form of covers which are made of material of the cap 103 which is thinner than the rest of the cap 103 and is connected to the rest of the cap by frangible connections. Each lug 115 and opening 116 is rectangular in the embodiment shown. The openings 116 and the lugs 115 comprise the second drive means 110.

Between the openings 116 and the wall 118 there are four resilient depending tongues 117 which in the position of the closure device on the opening, do not touch the outer surface of the end member 104 of the inner cap 102.

Both inner and outer caps 102 and 103 are injection moulded in one shot from plastics material.

The inner and outer caps 102 and 103 are assembled together by springing the inner cap 102 over a retaining ring 119 of the skirt of the outer cap 103, an outwardly directed circumferential ring 120 of the skirt of the inner cap 102 serving to maintain the skirts 106 and 107 at the correct spacing and preventing the outer skirt from being squeezed by inner pressure forcibly to remove the closure device from the opening in use.

In order to mount the closure device 100 on the opening of a bottle, the closure device 100 is offered up to the bottle so that the threads are engaged, and the device 100 is screwed onto the bottle on rotation being applied to the outer cap 103. The dogs and ratchets 109 and 110 engage to drive the inner and outer caps 102 and 103 in unison in the screwing-on position. The taper of the dogs and ratchets 109 and 110 keeps the end members 103 and 104 apart with the tongues 117 clear of the end member 104 of the inner cap 102.

If the outer cap 103 is now rotated in the opposite sense, the dogs 110 "click" over the ratchets 109 so that the outer cap 103 rotates relative to the inner cap 102. The closure device 100 stays mounted on the opening. In order to remove it, it is necessary to apply axial pressure in direction of arrow "A" moving the outer cap 103 over the inner cap 102 so that the end member 105 of the outer cap 103 approaches the end member 104 of the inner cap 102. At the same time as the axial force is applied, a rotational force is applied to the outer cap 103 until the two lugs 115 are aligned with a pair of openings 116. The lugs 115 enter the openings 116 and break the thinner material frangible means 112 away from the end member 105 by fracturing the frangible connections.

The second drive means 110 is now engaged, the lugs 115 engaging the sides of the associated openings 116 so that the caps 102 and 103 can be turned in unison to remove the device 100 from the opening. On release of the axial pressure once the device is removed from the opening the tongues and tapered ratchets and dogs return the inner and outer caps to the initial position shown in FIG. 9, in which the second drive means 110 is disengaged. During the axial movement in both directions the boss 114 and wall 118 act as a telescopic guide.

The frangible means 112 broken off from the openings indicates that the device has been removed at least once; in fact the broken off material provides tamper evidence. It will be appreciated that there is a plurality of pairs of openings 116 each axially covered by frangible means 112 and only one pair is utilised at any one removal. Therefore as the openings are each temporarily closed by removable material, the closure device embodying the invention provides a multiple taper evident closure. Stated in another way, a closure device embodying the invention can indicate that a plurality of attempts have been made to tamper with the device.

Referring now to FIGS. 10–13A of the drawings, in which like parts are indicated by like reference numerals, a closure device 200 for a container has inner and outer closure members 202 and 203 both injection moulded from plastics material. The outer closure member 202 has an end member 204 and a skirt member (not shown). The inner closure member 203 has an end member 205 and a skirt member (not shown). The inner closure 203 is permanently inside the outer closure member 202, and first driving means in the form of ratchets and dogs (also not shown but similar to those described for the second embodiment) on the skirt members engage to drive the inner and outer closure members 202 and 203 on rotation in unison in a direction to mount the closure device 200 on an opening, usually a screw-threaded neck of a bottle or jar the inner surface of the skirt of the inner closure member 203 having threads for mating with the screw-threaded neck.

Rotation in the opposite sense causes the dogs and ratchets to ride over one another, without operative engagement, so that the outer closure member 202 rotates with respect of the inner closure member 203 and the closure device 200 as a whole stays mounted on the neck.

There is a second drive means comprising a through opening 206 in the end member 204 of the outer closure member 202 and an upstanding dog 207 of complementary shape which is on the end member 205 of the inner closure member 203. The dog 207 is below the inner surface of end member 204 of the outer closure member 202, which end member 204 is spaced from the end member 205 of the inner closure member 203. The end members 204 and 205 are maintained apart by the dogs and ratchets between the skirt members, which taper longitudinally to provide this spacing, which is the usual disposition.

The through openings 200 has integrally formed therein a member 208 which is connected to the boundary of the opening 206 by frangible means in the form of a relatively thin skin 209 of plastics all the way round. The member 208 also has an upstanding tab 210. The member 208 itself conforms to the shape of the openings 6 (FIGS. 12 to 14) or extends across the opening (FIG. 10) and is connected by the thin skin 209 to part of the second drive means in the form of the boundary wall of the opening 206. The member 208 conceals the second drive means because in situ it is not evident how the closure device 200 is to be removed from the neck. To remove the closure device 200 therefrom, it is necessary to grasp the tab 210 and lift it to break the frangible means in the form of the skin 209, to remove the member 208 physically from the end member 204 of the outer closure member 202. The outer closure member 202 is then rotated and pushed axially towards the inner closure member 203 until the dog 207 enters the opening 206. Torque in the anti-clockwise or opposite (opening) sense then causes the boundary surfaces of the opening 206 and dog 208, comprising the second drive means, to engage firmly so that on continued rotation the inner and outer closure member 202 and 203 are driven in unison to remove the closure device 200 from the neck. The member 208 is a tamper evident member in that its removal gives immediate evidence that an attempt has been made to remove the closure device 200 from the opening.

It will be understood that as the second drive means is not self-locating, the removal of the member 208 to expose the opening 206 also provides a visual guide for actuation of the second drive means.

We claim:

1. A closure device for a container with a cylindrical opening, comprising:

(i) first and second cylindrical closure members each with an end member and a cylindrical skirt member;

(ii) resilient means between the first and second cylindrical closure members for normally biasing the respective end members apart;

(iii) first drive means between the respective cylindrical skirt members of said first and second closure members for driving the members in unison in one direction only to mount the closure on the opening;

(iv) second drive means operative on application of axial pressure to the closure to drive the closure in the opposite direction for removal from the opening, the second drive means including:

(a) an orifice through one end member; and (b) a projection on the other end member; whereby on axial movement of the first and second members towards one another to overcome the bias of the resilient means and on engagement of the projection in the orifice, the closure members are turnable in unison in said opposite direction to remove the device from the opening; and (v) removable cover means at least partly closing the orifice in said normally biased apart position of the first and second cylindrical closure members for enabling a user to determine whether initial opening of the container has occurred.

2. A closure device as defined in claim 1, wherein the orifice is through the outer end member and wherein the projection is on the inner end member.

3. A closure device as claimed in claim 1, wherein the orifice and projection are of complementary shape.

4. A closure device as defined in claim 3, wherein the orifice and projection have a hexagonal shape as considered in plan view.

5. A closure device as defined in claim 2, wherein there is a plurality of orifices and projections.

6. A closure device as defined claim 2, wherein there is a plurality of orifices and projections and wherein there are more orifices than projections.

7. A closure device as defined in claim 6, wherein there are eight orifices and two projections.

8. A closure device as defined in claim 1, wherein there is a plurality of orifices and a plurality of projections and wherein the orifices are radially arranged and equiangularly spaced around the outer end member and the projections being diametrically arranged on the inner end member.

9. A closure device as defined in claim 8, wherein the orifices and projections are substantially rectangular in configuration, as considered in plan view.

10. A closure device as defined in claim 1, wherein the orifice is substantially hexagonal and the projection substantially rectangular in plan view.

11. A closure device as defined in claim 1, wherein the orifice and projection are substantially rectangular in plan view.

12. A closure device as defined in claim 1, wherein the orifice and projection are substantially cruciform in plan view.

13. A closure device as defined in claim 1, wherein the orifice and projection are substantially arcuate in plan view.

14. A closure device as defined in claim 1, wherein the cover is secured to said end member by means which is frangible by the projection on said axial movement.

15. A closure device as defined in claim 1, wherein the cover has a tab and is secured to said end member by means which is frangible on pulling the tab.

16. A container with a cylindrical opening, wherein there is a closure device as defined in claim 1, mounted on the cylindrical opening.

* * * * *